US010739040B2

(12) United States Patent
Choi et al.

(10) Patent No.: US 10,739,040 B2
(45) Date of Patent: Aug. 11, 2020

(54) AIR CONDTIONER

(71) Applicant: SAMSUNG ELECTRONICS CO., LTD., Suwon-si (KR)

(72) Inventors: Jae-Woo Choi, Suwon-si (KR); Du Han Jung, Suwon-si (KR); Jun Seok Kwon, Anyang-si (KR); Ki Seok Kim, Seoul (KR); Hyeong Joon Seo, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 105 days.

(21) Appl. No.: 15/643,050

(22) Filed: Jul. 6, 2017

(65) Prior Publication Data

US 2018/0058727 A1 Mar. 1, 2018

(30) Foreign Application Priority Data

Aug. 31, 2016 (KR) ..... 10-2016-0112048

(51) Int. Cl.
*F25B 1/00* (2006.01)

(52) U.S. Cl.
CPC ..... *F25B 1/00* (2013.01); *F25B 2500/12* (2013.01)

(58) Field of Classification Search
CPC ..... F25B 1/00; F25B 2500/12
See application file for complete search history.

(56) References Cited

U.S. PATENT DOCUMENTS 3,815,379 A * 6/1974 Scherer ..... F25B 41/067 62/296
5,457,290 A * 10/1995 Sase ..... F01N 1/089 181/258

(Continued)

FOREIGN PATENT DOCUMENTS

CN 1467440 A 1/2004
CN 1467449 A 1/2004

(Continued)

OTHER PUBLICATIONS

Chinese Office Action dated Jul. 15, 2019 in related Chinese Application No. 201710705392.5.

*Primary Examiner* — Filip Zec
(74) *Attorney, Agent, or Firm* — Staas & Halsey LLP

(57) ABSTRACT

Disclosed herein is an air conditioner in which flow noise of a refrigerant is reduced. An air conditioner includes a compressor configured to compress a refrigerant, an outdoor heat exchanger in which the refrigerant exchanges heat with outside air, an expansion device configured to expand the refrigerant, an indoor heat exchanger in which the refrigerant exchanges heat with indoor air, and a muffler configured to reduce flow noise of the refrigerant flowing into the indoor heat exchanger, wherein the muffler includes a shell including a refrigerant inlet and a refrigerant outlet, a first baffle disposed at one side of an inner part of the shell and including a plurality of first holes, a plurality of pipes inserted into the plurality of first holes and serving as passages through which the refrigerant moves, and a second baffle disposed at the other side of the inner part of the shell and including a plurality of second holes through which the refrigerant passing through the pipe passes.

20 Claims, 10 Drawing Sheets

(56) References Cited

U.S. PATENT DOCUMENTS 5,553,460 A * 9/1996 Isaacs ..... B01D 45/16 62/129
5,955,707 A * 9/1999 Fritz ..... B60H 1/3229 181/255
6,131,405 A * 10/2000 Griffin ..... F25B 43/02 62/470
6,148,631 A * 11/2000 Watanabe ..... F25B 41/003 181/196
6,446,454 B1 * 9/2002 Lee ..... F04B 39/0061 181/403
7,578,659 B2 * 8/2009 Fox ..... F04C 29/061 181/238
8,016,071 B1 * 9/2011 Martinus ..... F04B 39/0061 181/268
8,434,586 B2 * 5/2013 Pawelski ..... F04B 53/001 181/175
9,243,543 B2 * 1/2016 Bertrand ..... F01N 13/08
9,243,824 B2 * 1/2016 Wolfe, IV ..... F25B 40/00
9,457,214 B2 * 10/2016 Goto ..... A62C 35/58
2003/0074914 A1 * 4/2003 Hirakanu ..... F25B 13/00 62/324.6
2006/0037351 A1 * 2/2006 Kim ..... F01N 1/083 62/323.3
2007/0204927 A1 * 9/2007 Yamashita ..... F04B 11/00 138/26
2007/0245761 A1 10/2007 Lee et al.

FOREIGN PATENT DOCUMENTS

CN 1143995 C 3/2004
CN 1888741 A 1/2007
KR 10-2003-0095626 12/2003
KR 10-2006-0010278 2/2006
KR 10-2006-0081840 A 7/2006
KR 10-2006-0087227 A 8/2006
KR 10-2006-0087228 A 8/2006
KR 10-2014-0067810 A 6/2014

* cited by examiner

AIR CONDTIONER

CROSS-REFERENCE TO RELATED APPLICATIONS

This application claims the priority benefit of Korean Patent Application No. 10-2016-0112048, filed on Aug. 31, 2016 in the Korean Intellectual Property Office, the disclosure of which is incorporated herein by reference.

BACKGROUND

1. Field

The present disclosure relates to an air conditioner, and more particularly, to an air conditioner including a muffler to reduce noise of a refrigerant.

2. Description of the Related Art

Generally, the air conditioner uses a refrigeration cycle to control temperature, humidity, and air flow suitable for human activity, and to remove dust and the like in the air. The main components of the refrigeration cycle include a compressor, a condenser, an expansion device, and an evaporator.

The air conditioner includes an outdoor unit and an indoor unit, and the outdoor unit may include a compressor, an outdoor heat exchanger, an expansion device, and the like. The indoor unit may include an indoor heat exchanger and an air blowing fan, and the expansion device may be provided in the indoor unit.

On the other hand, when a two-phase refrigerant discharged from the outdoor unit of the air conditioner flows through a pipe buried in an apartment, the flow of the refrigerant may become unstable due to foreign matter in the pipe or due to a pipe bending. That is, the refrigerant may form a slug flow, and when the refrigerant in a state of the slug flow flows into the indoor heat exchanger, irregular refrigerant noise may occur.

SUMMARY

One aspect of the present disclosure provides a muffler capable of improving flow noise of irregular refrigerant and an air conditioner including the muffler.

Another aspect of the present disclosure provides a muffler capable of stabilizing a flow of unstable refrigerant and an air conditioner including the muffler.

In accordance with an aspect of present disclosure, an air conditioner includes a compressor configured to compress a refrigerant, an outdoor heat exchanger in which the refrigerant exchanges heat with outside air, an expansion device configured to expand the refrigerant, an indoor heat exchanger in which the refrigerant exchanges heat with indoor air; and a muffler configured to reduce flow noise of the refrigerant flowing into the indoor heat exchanger, wherein the muffler includes a shell including a refrigerant inlet and a refrigerant outlet, a first baffle disposed at one side of an inner part of the shell and including a plurality of first holes, a plurality of pipes inserted into the plurality of first holes and serving as passages through which the refrigerant moves, and a second baffle disposed at the other side of the inner part of the shell and including a plurality of second holes through which the refrigerant passing through the pipe passes.

One end of the pipe may be disposed between the refrigerant inlet and the first baffle, and the other end of the pipe may be disposed between the first baffle and the second baffle.

The pipe may include a linear portion extending in a longitudinal direction of the shell and a bending portion provided at an end of the linear portion.

The plurality of pipes may have lengths different from each other.

The shell may include a body portion having a cylindrical shape, a first end cap coupled to one end of the body portion and including the refrigerant inlet, and a second end cap coupled to the other end of the body portion and including the refrigerant outlet.

The body portion may have a diameter larger than a diameter of the refrigerant inlet and a diameter of the refrigerant outlet.

The first baffle may be disposed adjacent to the first end cap and the second baffle may be disposed adjacent to the second end cap.

The plurality of first holes of the first baffle may not be disposed on straight lines passing through the plurality of second holes of the second baffle and parallel to the pipe.

The muffler may be installed between the expansion device and the indoor heat exchanger.

In accordance with an aspect of present disclosure, an air conditioner includes a compressor configured to compress refrigerant, an outdoor heat exchanger in which the refrigerant exchanges heat with outside air, an expansion device configured to expand the refrigerant, an indoor heat exchanger in which the refrigerant exchanges heat with indoor air, and a muffler configured to reduce flow noise of the refrigerant flowing into the indoor heat exchanger, wherein the muffler includes a shell including a refrigerant inlet and a refrigerant outlet, a baffle disposed inside the shell and including a plurality of holes, a plurality of pipes inserted into the plurality of holes, respectively, and serving as passages through which refrigerant flows, and a mesh plate disposed inside the shell and positioned between an end of the pipe and the refrigerant outlet.

The pipe may include a first section disposed between the refrigerant inlet and the baffle, and a second section disposed between the baffle and the mesh plate.

The pipe may be disposed such that the first section is shorter than the second section.

The plurality of pipes may have lengths different from each other.

The pipe may include a linear portion extending in a longitudinal direction of the shell and a bending portion provided at an end of the linear portion.

The bending portion may be bent in a direction which is perpendicular to a longitudinal direction of the shell and a radial direction of the shell.

In accordance with an aspect of present disclosure, a muffler for an air conditioner includes a shell including a refrigerant inlet and a refrigerant outlet, a plurality of pipes located inside the shell and serving as passages through which a refrigerant flows, a first baffle disposed at an one side of an inner part of the shell and including a plurality of first holes into which the plurality of pipes are respectively inserted, and a second baffle disposed at the other side of the inner part of the shell and including a plurality of second holes through which the refrigerant passes.

The plurality of pipes may be arranged in a longitudinal direction of the shell.

The plurality of pipes may have lengths different from each other.

Each of the plurality of pipes may include a bending portion, and each of the bending portions may be bent in a different direction.

The plurality of first holes of the first baffle may not be disposed on straight lines passing through the plurality of second holes of the second baffle and parallel to the pipe.

BRIEF DESCRIPTION OF THE DRAWINGS

These and/or other aspects of the disclosure will become apparent and more readily appreciated from the following description of embodiments, taken in conjunction with the accompanying drawings of which.

DETAILED DESCRIPTION

Hereinafter, embodiments according to the present disclosure will be described in detail with reference to the accompanying drawings.

Figure 1:
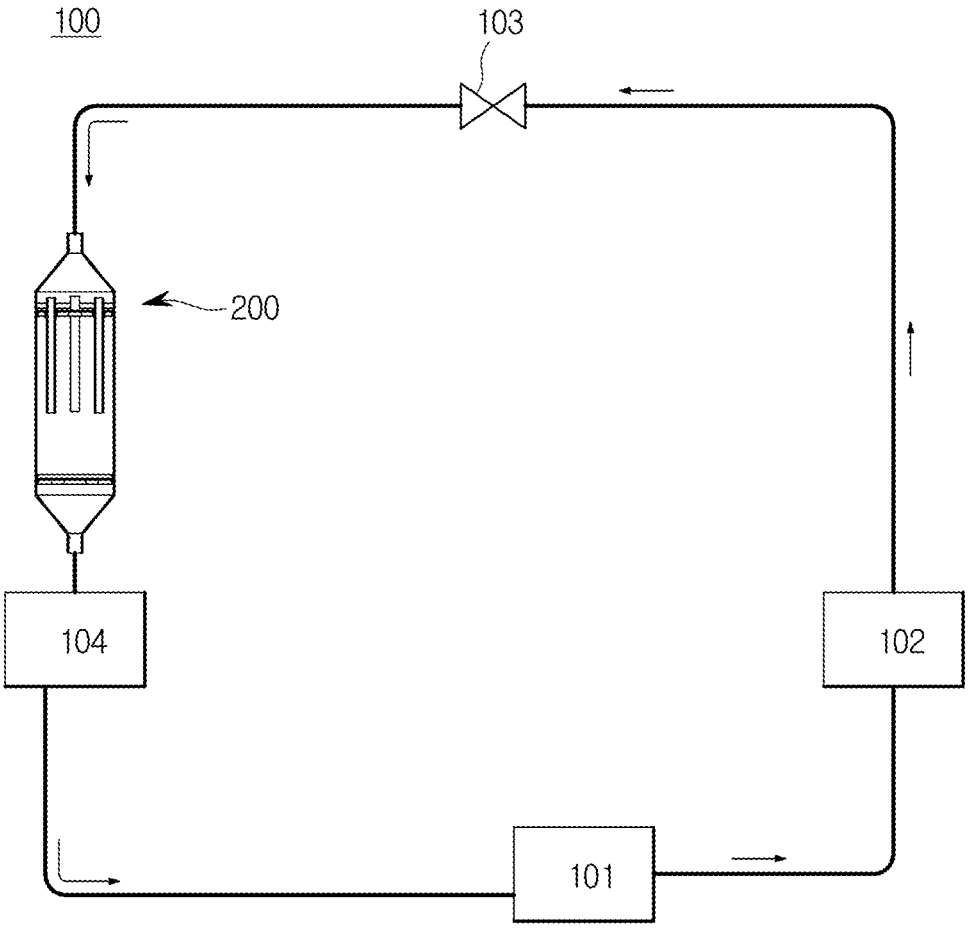
FIG. 1 is a refrigerant flow chart of an air conditioner according to an embodiment of the present disclosure.

FIG. 1 is a refrigerant flow chart of an air conditioner 100 including a muffler according to an embodiment of the present disclosure.

As shown in FIG. 1, the air conditioner 100 may include a compressor 101 configured to compress a refrigerant, an outdoor heat exchanger 102 configured to heat-exchange a compressed high-temperature and high-pressure refrigerant with outdoor air, an expansion device 103 configured to reduce a pressure of the refrigerant discharged from the outdoor heat exchanger 102 to a low temperature state, a muffler 200 connected to the expansion device 103 to stabilize a unstable refrigerant flow to reduce a flow noise of the refrigerant, and an indoor heat exchanger 104 connected to the muffler 200 and configured to reduce a temperature of room air by heat-exchanging the low temperature state refrigerant with indoor room air. The outdoor heat exchanger may refer to a condenser, and the indoor heat exchanger may refer to an evaporator.

A flow of the refrigerant in the air conditioner 100 having the above-described configuration is as follows.

A low temperature and low pressure gaseous refrigerant is compressed to a high temperature and a high pressure while passing through the compressor 101, and then is phase-changed into a liquid state in the outdoor heat exchanger 102. The refrigerant in the liquid state, passing through the outdoor heat exchanger 102, passes through the expansion device 103 and enters the two-phase state.

At this time, the flow of the refrigerant in the two-phase state may become unstable due to a condition of the pipe through which the refrigerant flows, for example, the flow instability due to the foreign substances in the pipe or the pipe bending. That is, the refrigerant may form a slug flow, and if the refrigerant in the slug flow state flows into the indoor heat exchanger 104, irregular refrigerant noise may occur.

The air conditioner 100 according to an embodiment of the present disclosure includes the muffler 200 between the expansion device 103 and the indoor heat exchanger 104 to stabilize the flow of the refrigerant so that the irregular refrigerant noise may be reduced.

The refrigerant may flow into the muffler 200 through the expansion device 103. As described above, the unstable refrigerant flow is stabilized through the muffler 200 and flows into the indoor heat exchanger 104. The refrigerant evaporates in the indoor heat exchanger 104 and becomes a low temperature and low pressure gaseous refrigerant.

Figure 2:
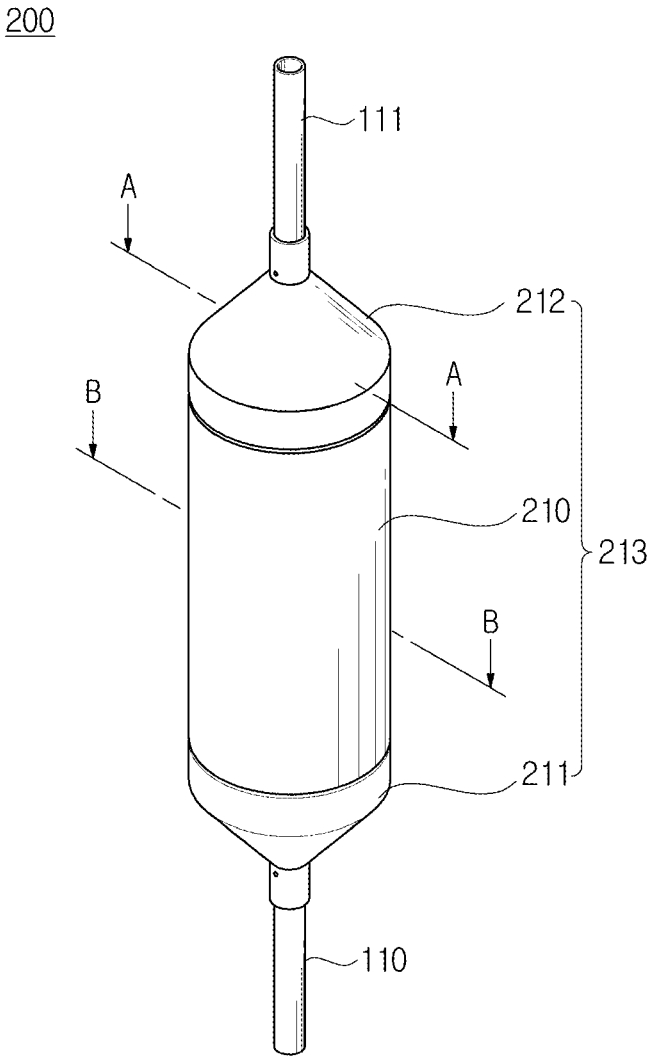
FIG. 2 is a perspective view of a muffler according to an embodiment of the present disclosure.
Figure 3:
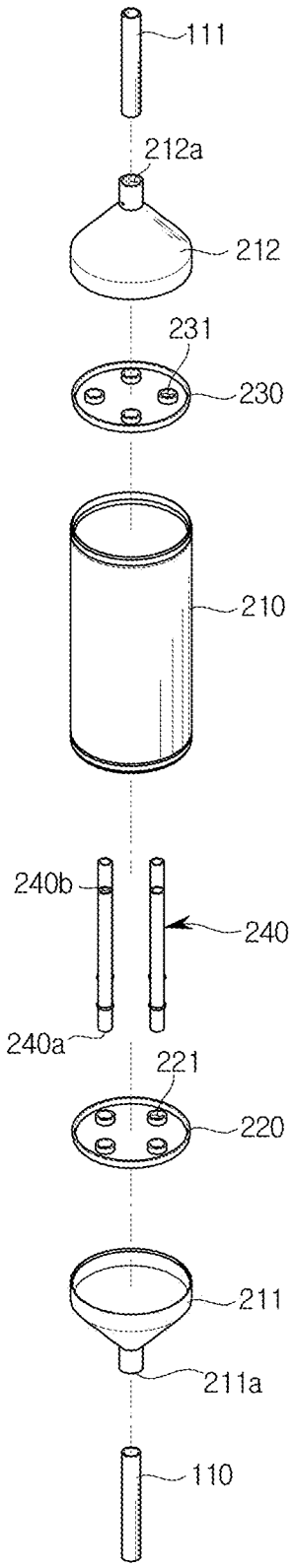
FIG. 3 is an exploded perspective view of the muffler shown in FIG. 2.

FIG. 2 is a perspective view of a muffler according to an embodiment of the present disclosure and FIG. 3 is an exploded perspective view of the muffler shown in FIG. 2.

As shown in FIGS. 2 and 3, the muffler 200 may include a shell 213 that includes a refrigerant inlet 211*a* and a refrigerant outlet 212*a* and forms the external appearance of the muffler, a first baffle 220 disposed at one side of an inner part of the shell 213, a pipe 240 disposed inside the shell 213 and serving as a passage through which the refrigerant moves, and a second baffle 230 disposed at the other side of the inner part of the shell 213.

The shell 213 includes a body portion 210 having a cylindrical shape, a first end cap 211 coupled to one end of the body portion 210 and including the refrigerant inlet 211*a*, and a second end cap 212 coupled to the other end of the body portion 210 and including the refrigerant outlet 212*a*.

The first end cap 211 includes the refrigerant inlet 211*a* and a pipe 110 may be connected to the refrigerant inlet 211*a* to allow the refrigerant to move. The refrigerant inlet 211*a* is formed at one end of the first end cap 211 and a diameter of the first end cap 211 may gradually increase toward the other end of the first end cap 211. The other end of the first end cap 211 may be connected to the body portion 210.

The second end cap 212 includes the refrigerant outlet 212*a* and a pipe 111 may be connected to the refrigerant outlet 212*a* to allow the refrigerant to move. The refrigerant outlet 212*a* is formed at one end of the second end cap 212 and a diameter of the second end cap 212 may gradually increase toward the other end of the second end cap 212. The other end of the second end cap 212 may be connected to the body portion 210.

That is, the first end cap 211 and the second end cap 212 may be connected to both ends of the body portion 210. A diameter of the body portion 210 may correspond to the maximum diameter of the first end cap 211 and the second end cap 212.

The first baffle 220, the second baffle 230, and the pipe 240 may be provided inside the shell 213.

The first baffle 220 may be disposed on one side of the inner part of the shell 213 and may include a first hole 221. The first baffle 220 may be a circular plate having a predetermined thickness. The first baffle 220 is provided in a circular shape so as to correspond to a cross section of the body portion 210 having a cylindrical shape.

The first baffle 220 may include a plurality of first holes 221 passing through the first baffle 220. The plurality of first holes 221 may be spaced apart from each other in the circumferential direction of the first baffle 220. However, the present disclosure is not limited to this, and a plurality of first holes may be disposed in the first baffle 220 in various ways.

The first baffle 220 may be coupled to an inner circumferential surface of the body portion 210 and the first baffle 220 may be disposed adjacent to the first end cap 211.

According to an embodiment of the present disclosure, the second baffle 230 may be provided in the same manner as the first baffle 220. That is, the first baffle 220 and the second baffle 230 may be interchangeable with each other. This is to prevent waste caused by producing the first baffle and the second baffle, respectively.

The second baffle 230 may be disposed on the other side of the inner part of the shell 213. The second baffle 230 may be disposed at the rear end of the shell 213 and adjacent to the second end cap 212. The second baffle 230 may be coupled to the inner circumferential surface of the body portion 210 in the same manner as the first baffle 220.

Figure 4:
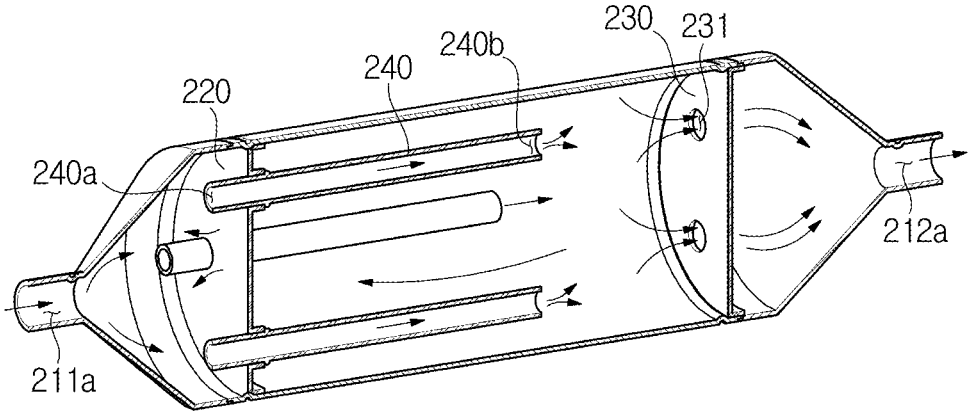
FIG. 4 is a partially cut perspective view of the muffler shown in FIG. 2.

FIG. 4 is a partially cut perspective view of the muffler shown in FIG. 2.

As shown in FIG. 4, the pipe 240 may be provided inside the shell 213. The pipe 240 may be inserted into the first hole 221 of the first baffle 220 and may be a passage through which the refrigerant moves. According to an embodiment of the present disclosure, the first baffle 220 is provided with a plurality of first holes 221, and the pipe 240 may be inserted into each of the plurality of first holes 221. That is, the number of pipes 240 may be provided to correspond to the number of first holes 221 of the first baffle 220.

The pipe 240 may be disposed in a direction parallel to the longitudinal direction of the shell 213. The first baffle 220 and the second baffle 230 may be disposed in a direction perpendicular to the longitudinal direction of the shell 213. The pipe 240 may be disposed perpendicular to the first baffle 220. Meanwhile, the longitudinal direction of the shell 213 may refer to an inflow direction of the refrigerant flowing into the refrigerant inlet 211*a* or an out flow direction of the refrigerant flowing out of the refrigerant outlet 212*a*.

One end 240*a* of the pipe 240 may be disposed between the refrigerant inlet 211*a* and the first baffle 220. The other end 240*b* of the pipe 240 may be disposed between the first baffle 220 and the second baffle 230. The refrigerant flowing in through the refrigerant inlet 211*a* flows into the one end 240*a* of the pipe 240, and flows out through the pipe 240 to the other end 240*b* of the pipe 240. Since the pipe 240 is inserted into each of the plurality of first holes 221 of the first baffle 220, the refrigerant flowing in through the refrigerant inlet 211*a* is mixed between the first end cap 211 and the first baffle 220, and then flows out through the pipe 240 to between the first baffle 220 and the second baffle 230. The refrigerant in the unstable flow state forming the slug flow flows into the refrigerant inlet 211*a* and is primarily mixed between the first end cap 211 and the first baffle 210.

Figure 5:
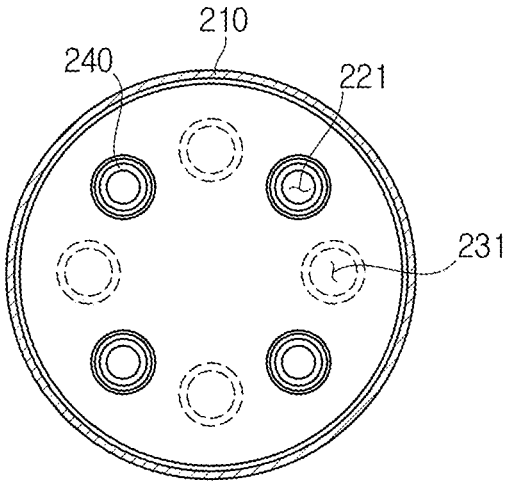
FIG. 5 is an overlapping view of a cross-sectional view taken along line A-A of FIG. 2 and a cross-sectional view taken along line B-B of FIG. 2.

The refrigerant mixed between the first end cap 211 and the first baffle 220 may flow into the pipe 240. The diameter of the pipe 240 may be smaller than the diameter of the first hole 221 of the first baffle 220 since the pipe 240 is inserted into the first hole 221 of the first baffle 220. The diameter of the pipe 240 may be smaller than the diameter of the body portion 210 of the shell 213. Since the diameter of the pipe 240 is smaller than the diameter of the body portion 210, the flow velocity of the refrigerant in the pipe 240 becomes faster than before the refrigerant is introduced in the pipe 240. The high velocity refrigerant that has passed through the pipe 240 is secondarily mixed between the first baffle 220 and the second baffle 230. The refrigerant flowing into the muffler 200 may be stabilized due to the two stages of mixing. The gas phase of the slug flow may be destroyed by the mixing to stabilize the flow. Therefore, the refrigerant flowing out of the refrigerant outlet 212*a* may be in a stable annular flow state. If such stable flow of refrigerant flows into the indoor heat exchanger 104, irregular noise is not generated in the indoor heat exchanger 104, and deterioration of user convenience due to refrigerant noise may be prevented. In other words, the user convenience of the air conditioner 100 may be improved FIG. 5 is an overlapping view of a cross-sectional view taken along line A-A of FIG. 2 and a cross-sectional view taken along line B-B of FIG. 2. In FIG. 5, a cross-sectional view taken along line A-A of FIG. 2 is shown by a solid line, and a cross-sectional view along line B-B is shown by a dashed line.

According to an embodiment of the present disclosure, the first holes 221 of the first baffle 220 and the second holes 231 of the second baffle 230 may be arranged so as not to face each other. The first holes 221 of the first baffle 220 are not disposed on straight lines passing through the second holes 231 of the second baffle 230 and parallel to the pipe 240.

The first baffle 220 and the second baffle 230 may be disposed at the front end and the rear end, or at one side and the other side of the body portion 210. As described above, the first baffle 220 and the second baffle 230 may be provided in the same manner. When the first holes 221 of the first baffle 220 and the second holes 231 of the second baffle 230 are disposed opposite to face each other, the refrigerant passing through the pipe 240 may directly pass through the second holes 231 of the second baffle 230. In this case, the mixing of the refrigerant may not be effectively performed between the first baffle 220 and the second baffle 230. In order to prevent this, the first holes 221 of the first baffle 220 may be disposed so as not to face the second holes 231 of the second baffle 230. The second baffle 230 may be disposed at a predetermined angle with respect to the first baffle 220. The first hole 221 of the first baffle 220 may not be disposed on any straight line passing through the second hole 231 of the second baffle 230 and parallel to the pipe 240. Similarly, the second hole 231 of the second baffle 220 may not be disposed on any straight line passing through the first hole 221 of the first baffle 220 and parallel to the pipe 240.

Hereinafter, the flow of the refrigerant will be briefly described.

The refrigerant flows into the shell 213 through the refrigerant inlet 221*a* and may be primarily mixed between the first end cap 211 and the first baffle 220. The refrigerant may pass through the pipe 240 and flow out between the first baffle 220 and the second baffle 230. Since the diameter of the pipe 240 is smaller than the diameter of the body portion 210, the flow velocity of the refrigerant in the pipe 240 may be increased. In the pipe 240, the refrigerant may form a flow path. That is, the refrigerant in the pipe 240 may form a separate flow path of refrigerant.

The refrigerant passing through the pipe 240 may flow out between the first baffle 220 and the second baffle 230. The refrigerant may be mixed between the first baffle 220 and the second baffle 230 and then flowed out of the refrigerant outlet 212*a* through the second holes 231 of the second baffle 230. The refrigerant flowing out of the refrigerant outlet 212*a* may flow into the indoor heat exchanger 104 and heat exchanged.

Figure 6:
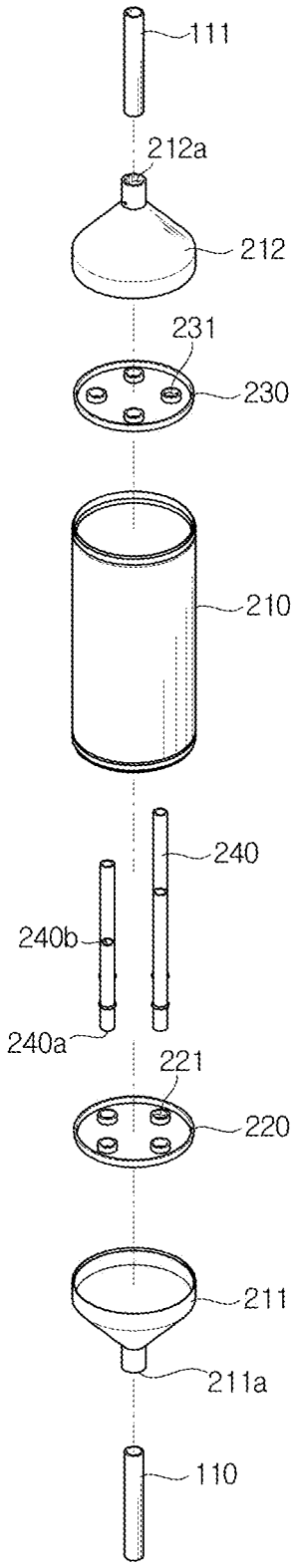
FIG. 6 is an exploded perspective view of a muffler according to another embodiment of the present disclosure.
Figure 7:
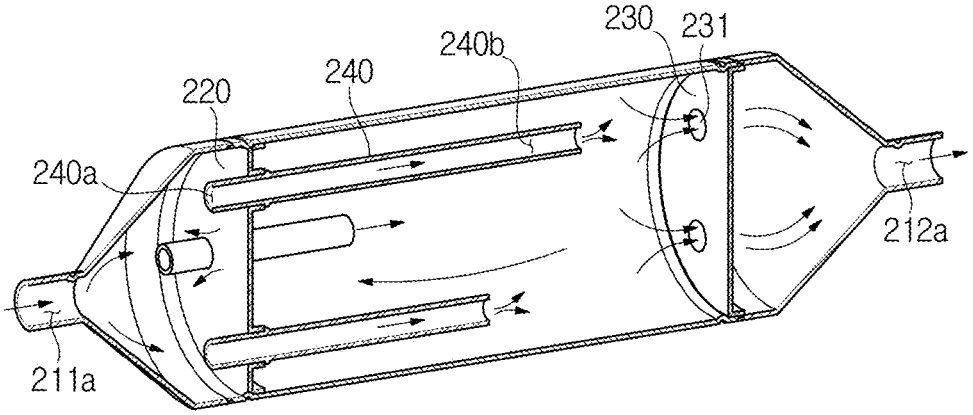
FIG. 7 is a partially cut perspective view of the muffler shown in FIG. 6.

FIG. 6 is an exploded perspective view of a muffler according to another embodiment of the present disclosure and FIG. 7 is a partially cut perspective view of the muffler shown in FIG. 6.

As shown in FIGS. 6 and 7, the pipe 240 in the muffler according to another embodiment of the present disclosure may have different lengths. Specifically, the other end 240*b* of the pipe 240 may discharge refrigerants at different positions. Accordingly, the refrigerant may be discharged at various positions after passing through the pipe 240, and the mixing of the refrigerant may be performed more efficiently.

As described above, the refrigerant flowing out of the other end 240*b* of the pipe 240 is mixed between the first baffle 220 and the second baffle 230, and then changed into a stable flow. The stabilized refrigerant flows out through the refrigerant outlet 212*a*.

Figure 8:
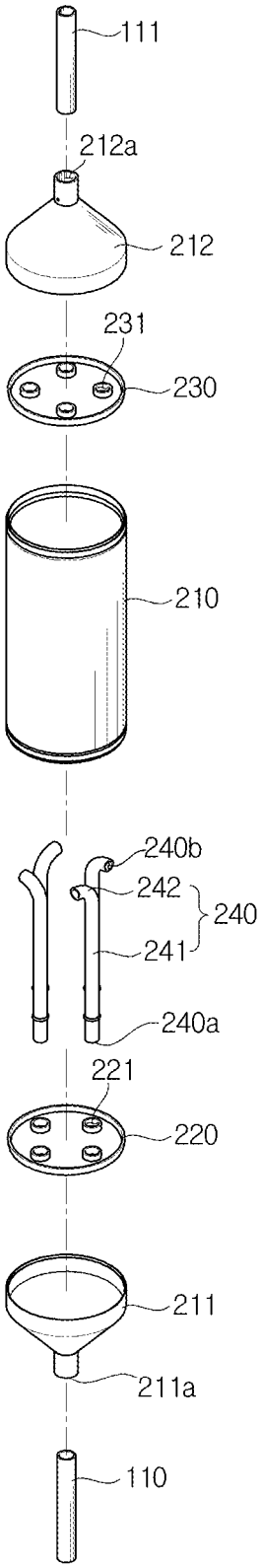
FIG. 8 is an exploded perspective view of a muffler according to another embodiment of the present disclosure.
Figure 9:
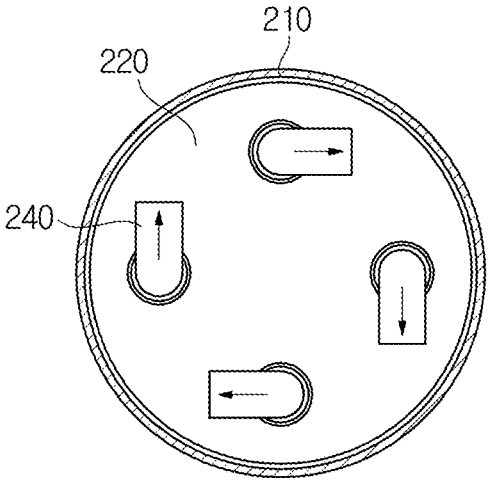
FIG. 9 is a plan view of a pipe and a first baffle of the muffler shown in FIG. 8.

FIG. 8 is an exploded perspective view of a muffler according to another embodiment of the present disclosure and FIG. 9 is a plan view of a pipe and a first baffle of the muffler shown in FIG. 8.

As shown in FIGS. 8 and 9, the pipe 240 may include a straight linear portion 241 extending in the longitudinal direction of the shell 213 and a bending portion 242 provided at an end of the straight linear portion 241. The straight linear portion 241 may extend in the longitudinal direction of the shell 213 and the bending portion 242 may be bent in a direction perpendicular to the longitudinal direction of the shell 213. In addition, the bending portion 242 may be bent in a direction perpendicular to the radial direction of the shell 213. That is, the bending portion 242 may be bent in a direction which is perpendicular to the longitudinal direction of the shell 213 and the radial direction of the shell 213.

The bending portion 242 may have a constant directionality. As shown in FIG. 9, the other ends of the pipes 240 may point in different directions, through which the refrigerant flow may be rotatable. Through the arrangement of the bending portion 242, the refrigerant may be more effectively mixed between the first baffle 220 and the second portion 230, and the flow of the refrigerant may be stabilized.

Figure 10:
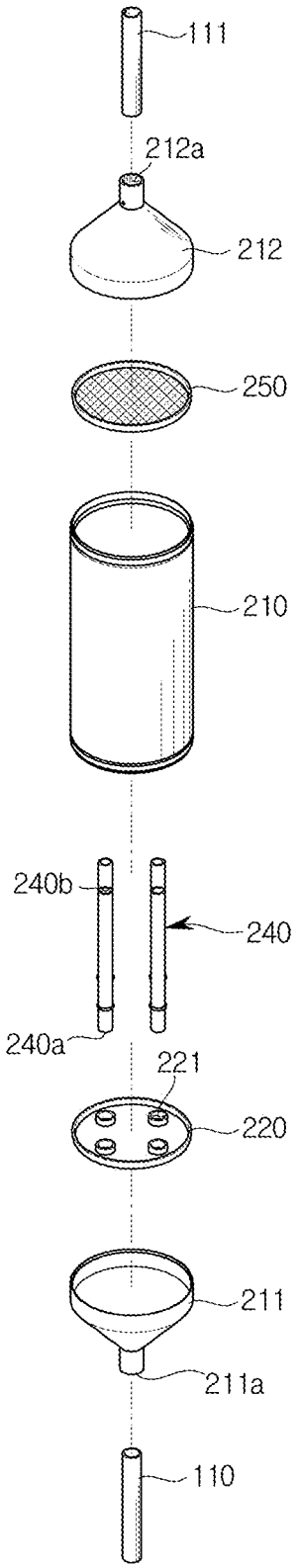
FIG. 10 is an exploded perspective view of a muffler according to another embodiment of the present disclosure.

FIG. 10 is an exploded perspective view of a muffler according to another embodiment of the present disclosure.

As shown in FIG. 10, the muffler 200 may include a mesh plate 250. The first baffle 220 may be disposed on one side of the inner part of the body portion 210 and the mesh plate 250 may be disposed on the other side of the inner part of the body portion 210. The mesh plate 250 may be provided instead of the second baffle.

The mesh plate 250 may be formed in a circular shape corresponding to the shape of the body portion 210 and may include a mesh shape therein.

By providing the mesh plate 250, the refrigerant passing through the pipe 240 may be mixed between the first baffle 220 and the mesh plate 250, and the gaseous phase may be destroyed by the mesh plate 250. The vapor phase of the refrigerant having undergone such a process is destroyed by the mesh plate 250, and the flow of the refrigerant may be stabilized through the mixing process of the refrigerant.

The flow of the refrigerant passing through the muffler 200 is stabilized and the refrigerant in the stabilized flow flows into the indoor heat exchanger 104 and irregular refrigerant noise is not generated, thereby improving user convenience.

Although a few embodiments of the present disclosure have been shown and described, it would be appreciated by those skilled in the art that changes may be made in these embodiments without departing from the principles and spirit of the disclosure, the scope of which is defined in the claims and their equivalents.

What is claimed is:

1. An air conditioner comprising:

a compressor configured to compress a refrigerant;

an outdoor heat exchanger in which the refrigerant exchanges heat with outside air;

an expansion device configured to expand the refrigerant;

an indoor heat exchanger in which the refrigerant exchanges heat with indoor air; and a muffler configured to reduce flow noise of the refrigerant flowing into the indoor heat exchanger;

wherein the muffler comprises:

a body portion, a first end cap coupled to an end of the body portion, the first end cap having a refrigerant inlet, a width of the first end cap increasing away from the refrigerant inlet toward the body portion, a second end cap coupled to another end of the body portion, the second end cap having a refrigerant outlet, a width of the second end cap increasing away from the refrigerant outlet toward the body portion, a first baffle disposed inside of the body portion between the refrigerant inlet and the refrigerant outlet and including a plurality of first holes, a second baffle, spaced apart from the first baffle, disposed inside of the body portion between the first baffle and the refrigerant outlet and including a plurality of second holes, and a plurality of pipes corresponding, respectively, to the first plurality of holes and configured to allow the refrigerant to flow toward the plurality of second holes from the plurality of pipes, each pipe of the plurality of pipes extending through the corresponding first hole of the plurality of first holes into a space between the first baffle and the second the second baffle.

2. The air conditioner according to claim 1, wherein one end of each of the plurality of pipes is disposed between the refrigerant inlet and the first baffle, and an opposite end of each of the plurality of pipes is disposed in the space between the first baffle and the second baffle.

3. The air conditioner according to claim 2, wherein the plurality of pipes include a linear portion extending in a longitudinal direction of the body portion and a bending portion provided at an end of the linear portion.

4. The air conditioner according to claim 1, wherein the plurality of pipes have lengths different from each other.

5. The air conditioner according to claim 1, wherein the body portion having a cylindrical shape.

6. The air conditioner according to claim 5, wherein the body portion has a diameter larger than a diameter of the refrigerant inlet and a diameter of the refrigerant outlet.

7. The air conditioner according to claim 5, wherein the first baffle is disposed adjacent to the first end cap and the second baffle is disposed adjacent to the second end cap.

8. The air conditioner according to claim 1, wherein the plurality of first holes of the first baffle are not disposed on straight lines passing through the plurality of second holes of the second baffle and parallel to the plurality of pipes.

9. The air conditioner according to claim 1, wherein the muffler is installed between the expansion device and the indoor heat exchanger.

10. An air conditioner comprising:

a compressor configured to compress refrigerant;

an outdoor heat exchanger in which the refrigerant exchanges heat with outside air;

an expansion device configured to expand the refrigerant;

an indoor heat exchanger in which the refrigerant exchanges heat with indoor air; and a muffler configured to reduce flow noise of the refrigerant flowing into the indoor heat exchanger;

wherein the muffler comprises:

a body portion, a first end cap coupled to an end of the body portion, the first end cap having a refrigerant inlet, a width of the first end cap increasing away from the refrigerant inlet toward the body portion, a second end cap coupled to another end of the body portion, the second end cap having a refrigerant outlet, a width of the second end cap increasing away from the refrigerant outlet toward the body portion, a baffle disposed inside the body portion and including a plurality of holes, a plurality of pipes inserted into the plurality of holes, respectively, and serving as passages through which refrigerant flows, and a mesh plate disposed inside the body portion and positioned between an end of the pipe and the refrigerant outlet.

11. The air conditioner according to claim 10, wherein the pipe includes a first section disposed between the refrigerant inlet and the baffle, and a second section disposed between the baffle and the mesh plate.

12. The air conditioner according to claim 11, wherein the pipe is disposed such that the first section is shorter than the second section.

13. The air conditioner according to claim 11, wherein the plurality of pipes have lengths different from each other.

14. The air conditioner according to claim 10, wherein the pipe includes a linear portion extending in a longitudinal direction of the body portion and a bending portion provided at an end of the linear portion.

15. The air conditioner according to claim 14, wherein the bending portion is bent in a direction which is perpendicular to a longitudinal direction of the body portion and a radial direction of the body portion.

16. A muffler for an air conditioner comprising:

a body portion;

a first end cap coupled to an end of the body portion, the first end cap having a refrigerant inlet, a width of the first end cap increasing in a direction away from the refrigerant inlet toward the body portion;

a second end cap couplable to another end of the body portion, the second end cap having a refrigerant outlet, a width of the second end cap increasing in a direction away from the refrigerant outlet toward the body portion;

a first baffle disposed inside of the body portion between the refrigerant inlet and the refrigerant outlet and including a plurality of first holes;

a second baffle, spaced apart from the first baffle, disposed inside of the body portion between the first baffle and the refrigerant outlet and including a plurality of second holes; and a plurality of pipes corresponding, respectively, to the first plurality of holes and configured to allow a refrigerant to flow toward the plurality of second holes from the plurality of pipes, each pipe of the plurality of pipes extending through the corresponding first hole of the plurality of first holes into a space between the first baffle and the second the second baffle.

17. The muffler according to claim 16, wherein the plurality of pipes are arranged in a longitudinal direction of the body portion.

18. The muffler according to claim 16, wherein the plurality of pipes have lengths different from each other.

19. The muffler according to claim 16, wherein each of the plurality of pipes includes a bending portion, and each of the bending portions is bent in a different direction.

20. The muffler according to claim 16, wherein the plurality of first holes of the first baffle are not disposed on straight lines passing through the plurality of second holes of the second baffle and parallel to the plurality of pipes.

* * * * *